US007478921B1

(12) United States Patent
Kotovsky et al.

(10) Patent No.: US 7,478,921 B1
(45) Date of Patent: Jan. 20, 2009

(54) METHOD AND APPARATUS FOR LIGHTING

(75) Inventors: Irwin Kotovsky, 3941 California Ave., Pittsburgh, PA (US) 15212; Serge Cornelissen, Roeselare (BE); Robert Cornelissen, Roeselare (BE)

(73) Assignee: Irwin Kotovsky, Pittsburgh, PA (US)

( * ) Notice: Subject to any disclaimer, the term of this patent is extended or adjusted under 35 U.S.C. 154(b) by 0 days.

(21) Appl. No.: 11/906,560

(22) Filed: Oct. 3, 2007

(51) Int. Cl.
*F21V 33/00* (2006.01)

(52) U.S. Cl. ..... 362/228; 362/225; 362/249; 362/342; 362/806

(58) Field of Classification Search ..... 362/217, 362/219, 221, 222, 225, 227, 228, 230, 231, 362/249, 247, 297, 304, 342, 800, 806
See application file for complete search history.

(56) References Cited

U.S. PATENT DOCUMENTS 6,948,830 B1 * 9/2005 Petrick ..... 362/229
7,121,678 B1 * 10/2006 Shetter ..... 362/184
2003/0020340 A1 * 1/2003 Shikayama et al. ..... 310/58

* cited by examiner

*Primary Examiner*—Laura Tso
(74) *Attorney, Agent, or Firm*—Ansel M. Schwartz

(57) ABSTRACT

An apparatus for lighting includes a fixture having a center axis. The apparatus includes a first light source disposed in the fixture which produces light along the center axis. The apparatus includes a grid having slots which reflect the light radially outward from the center axis extending from the fixture along the center axis and illuminated by the first light source. The apparatus includes a translucent element extending from the fixture along the center axis and disposed about and in spaced relationship with the grid. The apparatus includes a second light source disposed between the element and the grid. A method for lighting includes the steps of producing light along a center axis of a fixture with a first light source disposed in the fixture. There is the step of reflecting the light radially outward from the center axis with a grid having slots extending from the fixture along the center axis and illuminated by the first light source. There is the step of transmitting the light through a translucent element extending from the fixture along the center axis and disposed about and in spaced relationship with the grid. There is the step of producing light with a second light source disposed between the element and the grid.

12 Claims, 10 Drawing Sheets

METHOD AND APPARATUS FOR LIGHTING

FIELD OF THE INVENTION

The present invention is related to a lighting apparatus having multiple lighting sources for functionality as well as decorative lighting. More specifically, the present invention is related to a lighting apparatus having multiple lighting sources for functionality as well as decorative lighting that uses a grid to reflect light and LEDs.

BACKGROUND OF THE INVENTION

Historically, in different countries during different time of the year for festive purposes, municipalities and or private individuals will add colored strings of lights to their existing outdoor lighting fixtures for holidays such as Christmas, New Year, etc. and for other occasions such as weddings, baptisms and bar mitzvahs, etc.

The present invention will provide the opportunity of having functional light all the time and the ability to use the secondary source for festive purposes.

BRIEF SUMMARY OF THE INVENTION

The present invention pertains to an apparatus for lighting. The apparatus comprises a fixture having a central axis. The apparatus comprises a first light source disposed in the fixture which produces light along the center axis. The apparatus comprises a grid having slots which reflect the light radially outward from the center axis extending from the fixture along the center axis and illuminated by the first light source. The apparatus comprises a translucent element extending from the fixture along the center axis and disposed about and in spaced relationship with the grid. The apparatus comprises a second light source disposed between the element and the grid.

The present invention pertains to a method for lighting. The method comprises the steps of producing light along a center axis of a fixture with a first light source disposed in the fixture. There is the step of reflecting the light radially outward from the center axis with a grid having slots extending from the fixture along the center axis and illuminated by the first light source. There is the step of transmitting the light through a translucent element extending from the fixture along the center axis and disposed about and in spaced relationship with the grid There is the step of producing light with a second light source disposed between the element and the grid.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
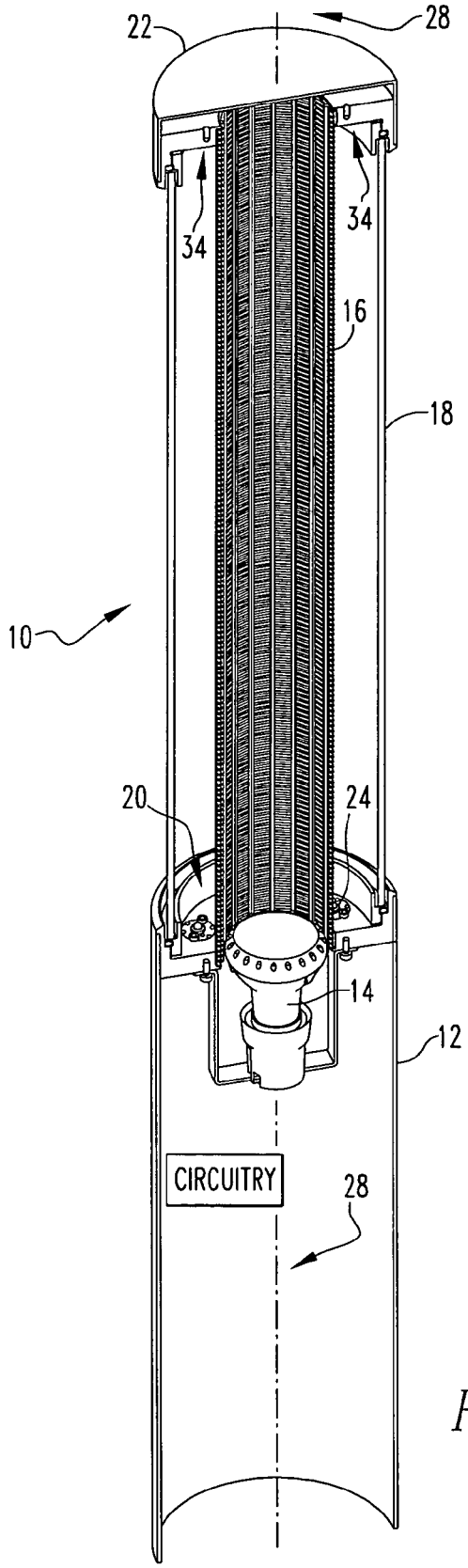
FIG. 1 shows a cutaway view of the apparatus of the present invention.
Figure 2:
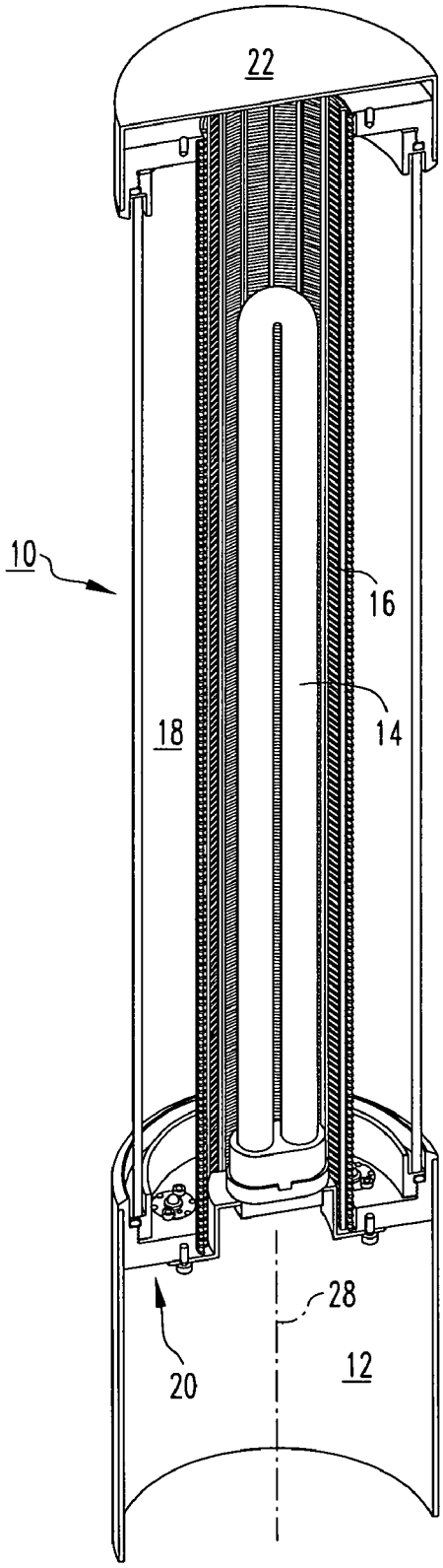
FIG. 2 is an alternative embodiment of the apparatus.
Figure 3:
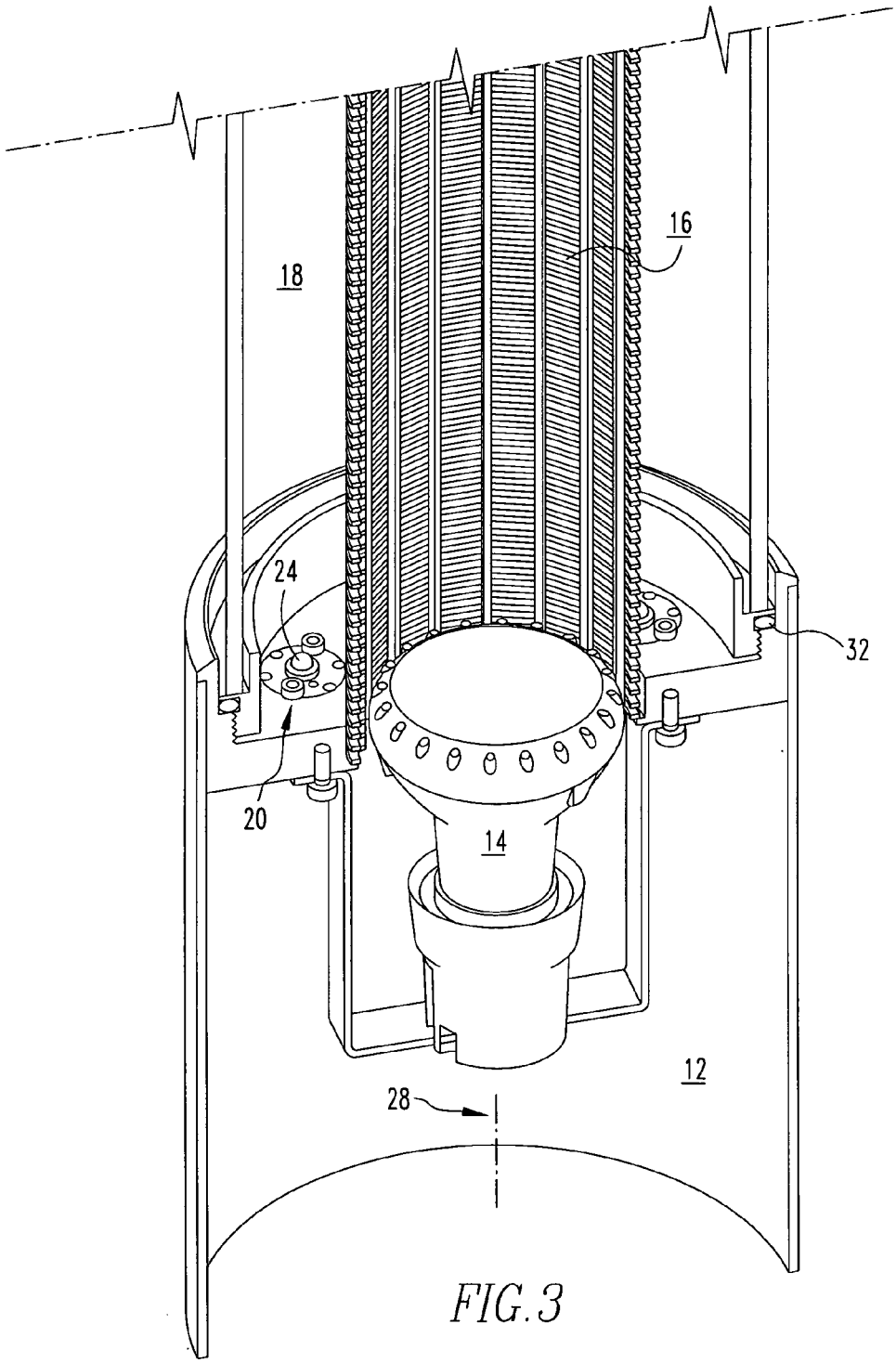
FIG. 3 is a perspective cutaway view of the apparatus.
Figure 4:
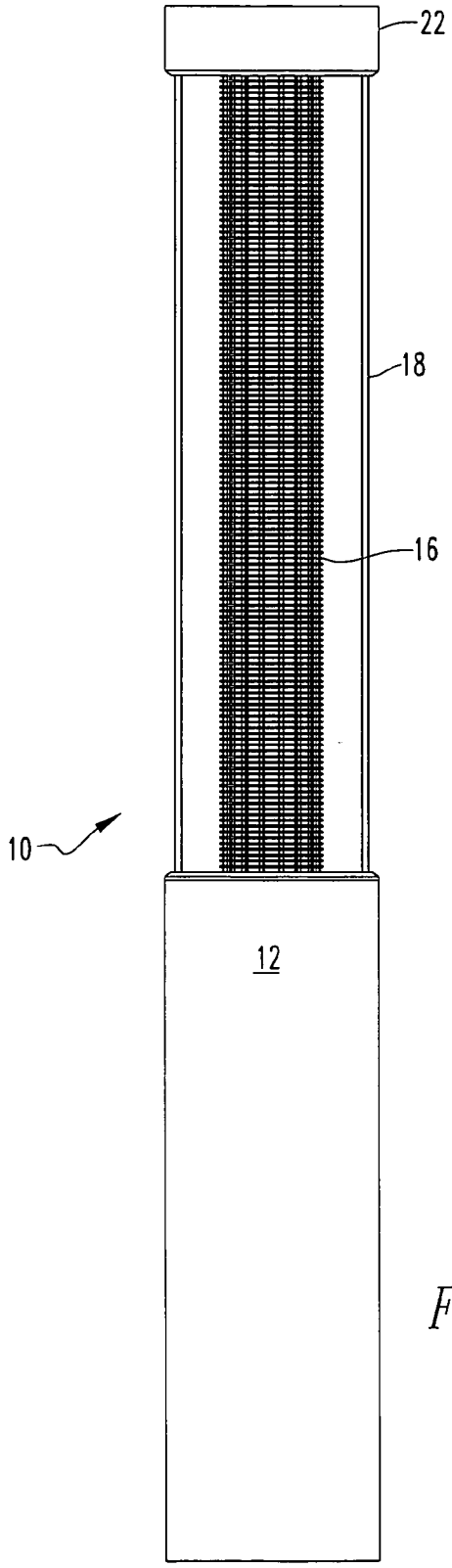
FIG. 4 is a side view of the apparatus.

Referring now to the drawings wherein like reference numerals refer to similar or identical parts throughout the several views, and more specifically to FIGS. 1-4 thereof, there is shown an apparatus 10 for lighting. The apparatus 10 comprises a fixture 12 having a central axis 28. The apparatus 10 comprises a first light source 14 disposed in the fixture 12 which produces light along the center axis 28. The apparatus 10 comprises a grid 16 having slots which reflect the light radially outward from the center axis extending from the fixture 12 along the center axis 28 and illuminated by the first light source 14. The apparatus 10 comprises a translucent element 18 extending from the fixture 12 along the center axis and disposed about and in spaced relationship with the grid 16. The apparatus 10 comprises a second light source 20 disposed between the element and the grid 16. FIG. 2 shows an embodiment where the first light source 14 is a fluorescent light that extends from the fixture 12 upwards along the center axis 28.

Figure 5:
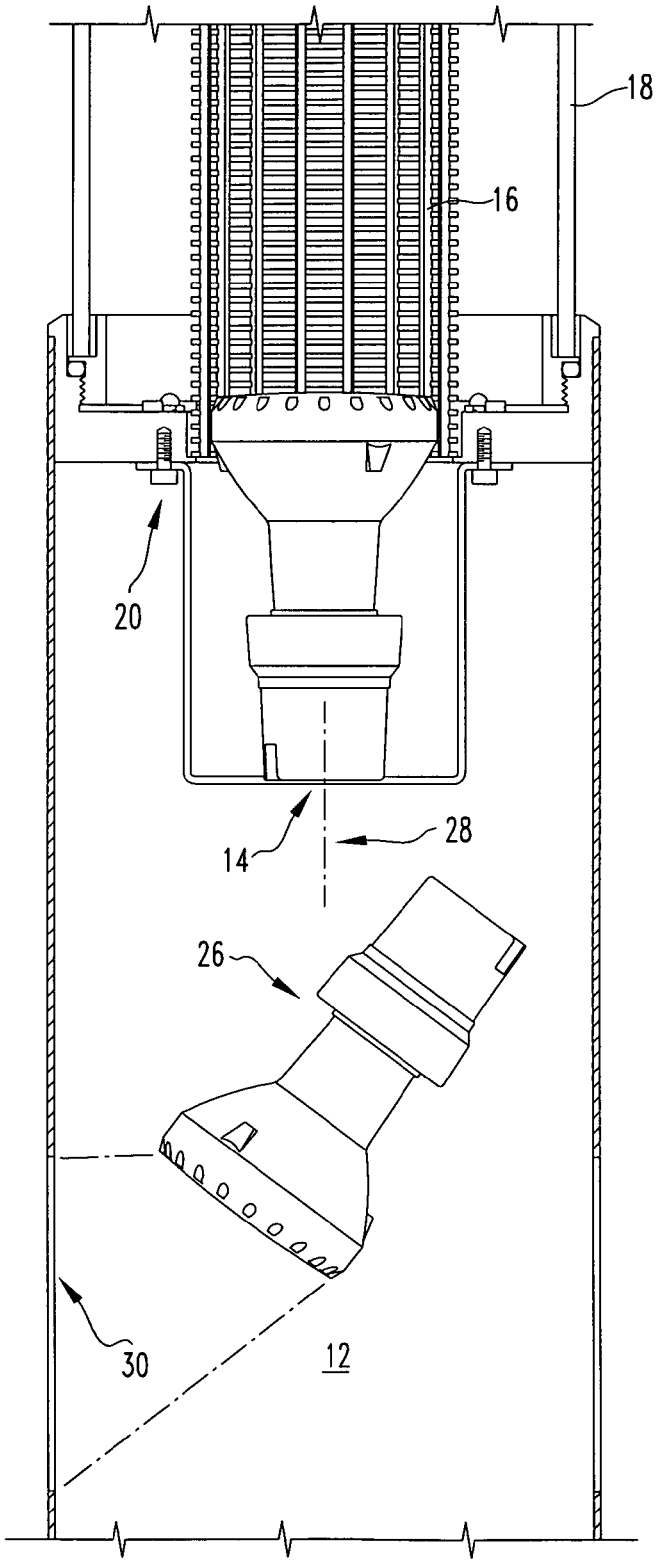
FIG. 5 is a cutaway view of another embodiment of the apparatus.

Preferably, the apparatus 10 includes a cap 22 disposed on the elements and the grid 16. The cap 22 can have one of more mirrors 34 which reflect the light from the first light source 14. The second light source 20 preferably includes LEDs 24. Preferably, the fixture 12 is hollow and contains wiring to operate the first and second light sources 14, 20. The fixture 12 preferably includes circuitry to control the operation of the first and second light sources 14, 20. Preferably, the apparatus 10 includes a third light source disposed in the fixture 12, and wherein the fixture 12 has an opening 30 in its side through which light from the third source 26 emanates, as shown in FIG. 5. Preferably, the first light source 14 is recessed in the fixture 12 at the fixture's top so the first light source 14 itself is not visible by looking at the apparatus 10 sideways.

Figure 6:
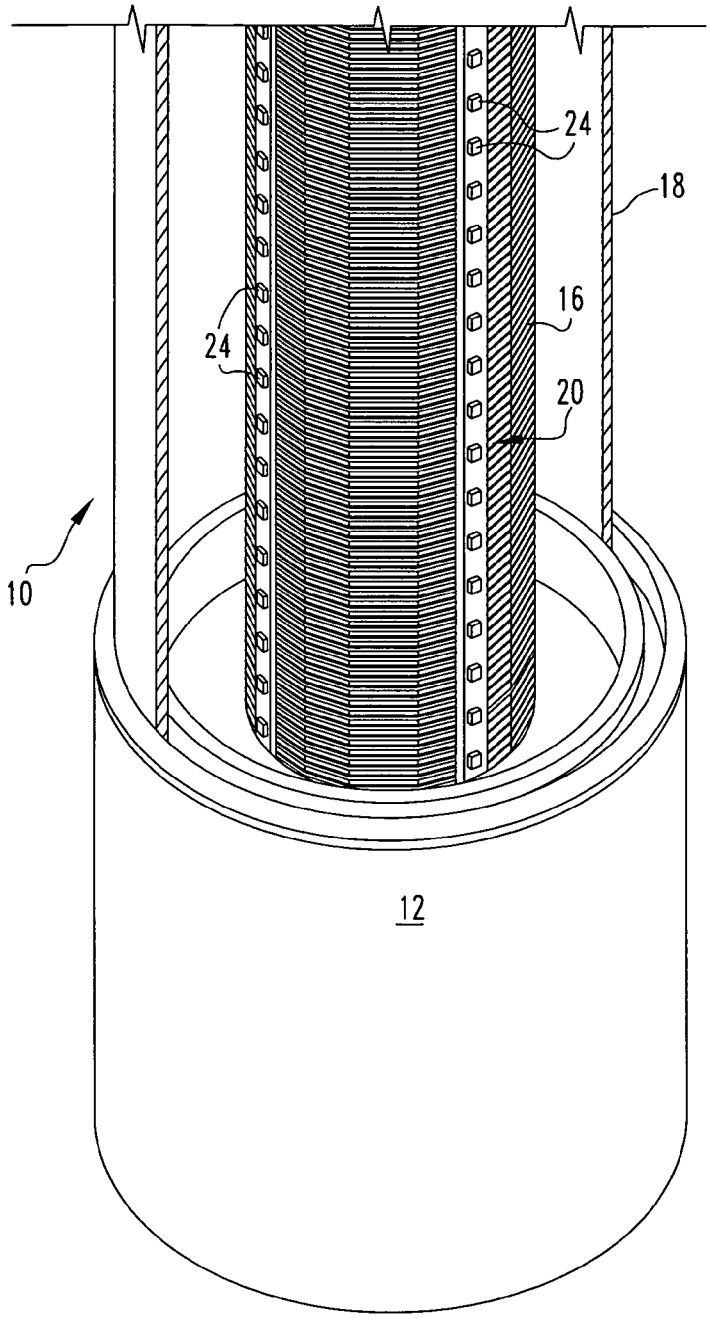
FIG. 6 is a perspective cutaway view of another embodiment of the apparatus.
Figure 7:
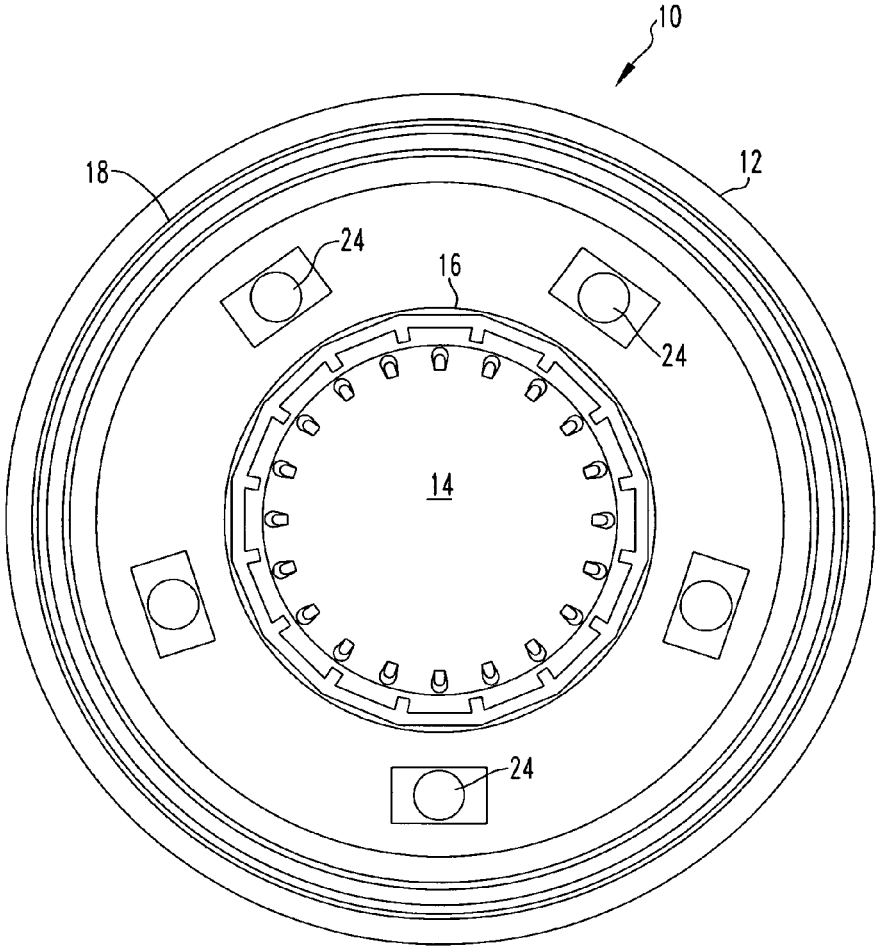
FIG. 7 shows a circular array of individual LEDs, projecting light vertically along the grid.
Figure 8:
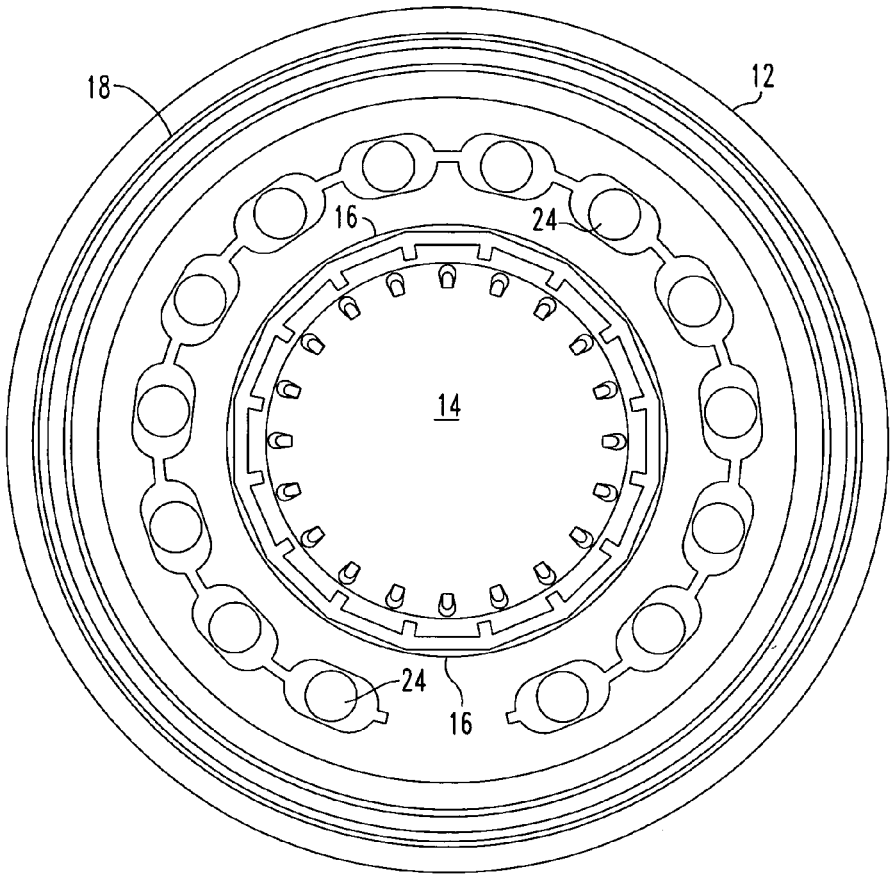
FIG. 8 shows a ring shaped printed circuit board containing a circular array of LEDs, projecting light along the grid.
Figure 9:
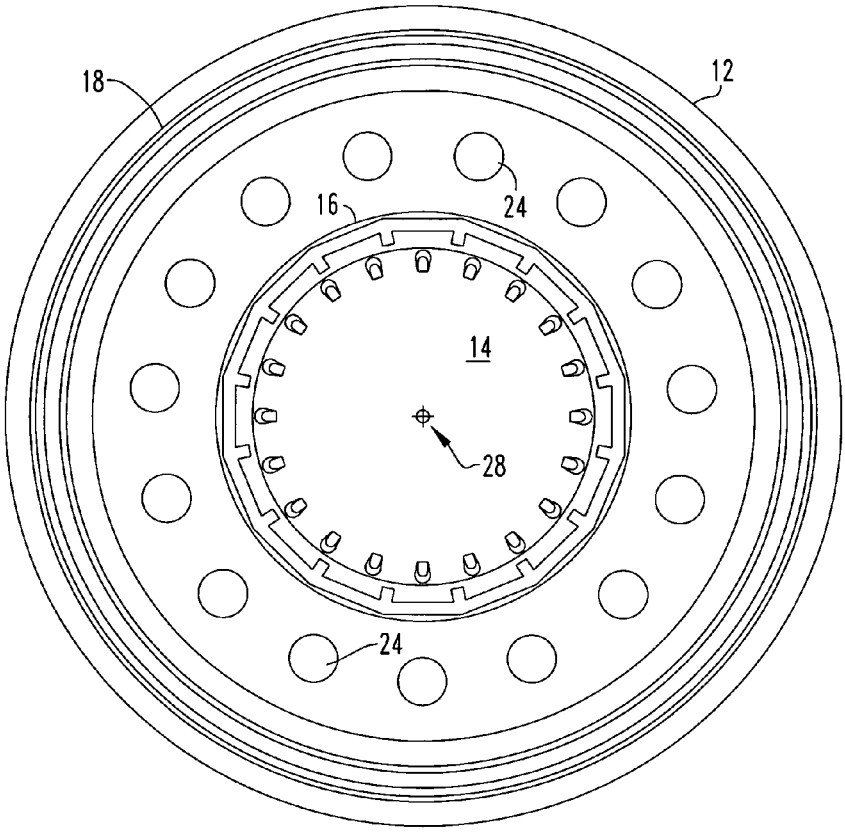
FIG. 9 shows a flexible LED strip, arranged in a circular shape, projecting light vertically along the grid.
Figure 10:
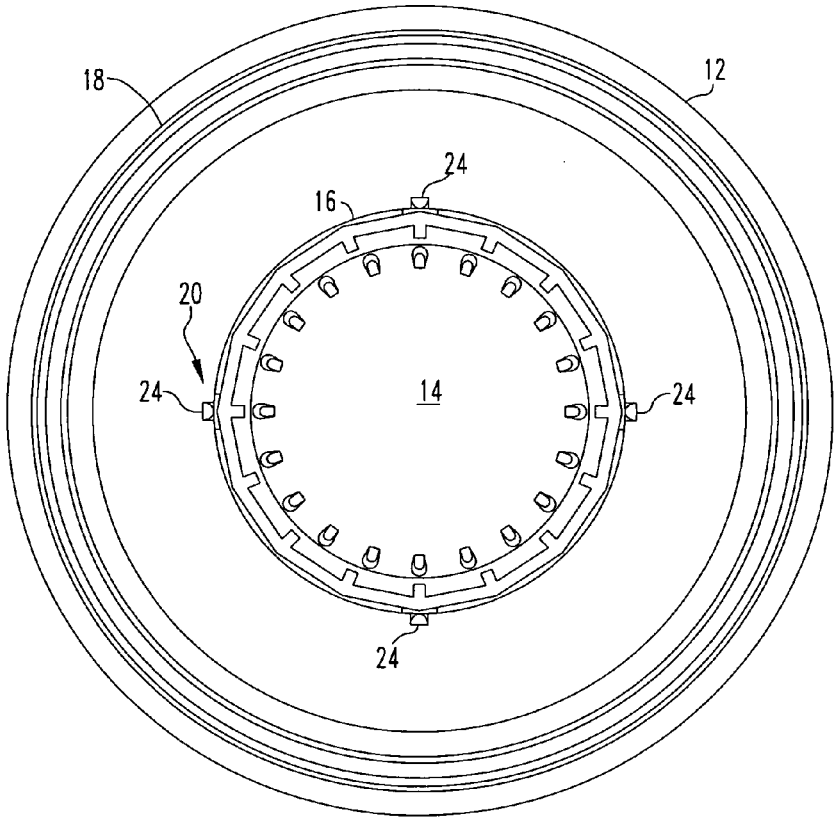
FIG. 10 shows a circular array of LED strips, vertically mounted against the grid, projecting light horizontally towards the transparent element.

The LEDs 24 can extend along the central axis 28 as shown in FIGS. 6 and 10. The LEDs 24 can be disposed radially about the first light source 14, as shown in FIGS. 7-9. Preferably, the fixture 12, element and the grid 16 are cylindrically shaped.

The present invention pertains to a method for lighting. The method comprises the steps of producing light along a center axis 28 of a fixture 12 with a first light source 14 disposed in the fixture 12. There is the step of reflecting the light radially outward from the center axis 28 with a grid 16 having slots extending from the fixture 12 along the center axis and illuminated by the first light source 14. There is the step of transmitting the light through a translucent element 18 extending from the fixture 12 along the center axis and disposed about and in spaced relationship with the grid 16. There is the step of producing light with a second light source 20 disposed between the element and the grid 16.

Preferably, the producing the light with the second light source 20 includes the step of producing the light with LEDs 24. There is the step of controlling the first light source 14 and the LEDs 24 with circuitry to cause a desired lighting effect.

The apparatus 10 can be used for indoor and outdoor lighting. The concept is based upon the use of multiple light sources within a fixture 12. The use of multiple sources provides the opportunity of providing one source of light for utilitarian illumination that is required to meet specific lighting requirements. The second source is to add sparkle to the fixture's 12 general appearance or provide soft low levels of visually comfortable illumination. A third source 26 (for downlighting) if used can provide walkway, night lighting, ground covering or plant illumination.

The construction of the fixture 12, whatever the mounting method, can be round or square, made of many different materials such as stainless steel, aluminum, steel, wood, granite, marble, stone, plastics or synthetic composites.

One of the sources is mounted in the center of the enclosure and projects light upward, as shown in FIGS. 1-4. A tubular element, square or round, is placed on the outside diameter of the center source and is illuminated by this source. This tubular element can be grid 16 in structure, polished or brushed, and made of stainless steel, aluminum or any other metallic or non-metallic materials. It will reflect light outward and upward or downward and outward or depending upon the angular cut upward only or downward only. The grid 16 effectively has over a hundred slots to reflect light. A second source will be placed outside the grid 16 between the grid 16 and the outer tubular, cylindrical or square plastic, glass, granite, marble, etc. to complete the structural integrity of the luminare. An o-ring joint 32 is used to hold the element 18 to the fixture 12.

The center source can be line voltage incandescent, low voltage halogen, metal halide or compact fluorescent or tubular T2, T5 fluorescent or cold cathode.

The second source can be LEDs 24. All of the LEDs 24 can be one color or mixed colors. Color mixing, blending, sequencing and chasing is possible. Multiple circuiting for the various color LEDs 24 is also possible. Dimming, color changing is also possible. This second source will reflect light off of the tubular grid 16 and be visible through the outer tubular cylindrical or square tubular plastic (acrylic, polycarbonate, etc.) translucent element 18. If marble, granite, stone is used as the exterior element, it can be secured in a manner so that it appears to be floating (free of being visibly held from the bottom of the top of the fixture 12) so that light is emitted between the bottom of the outer structural element and the top of the outer structural element. The LEDs 24 can be individual and mounted around the circumference of the grid 16, as shown in FIG. 7. The LEDs 24 can also be mounted on a PC board in a circular pattern, as shown in FIG. 8. The LEDs 24 can be mounted on a soft strip which can be formed in a circular pattern for horizontal mounting or in a linear pattern for horizontal mounting or vertical mounting, as shown in FIG. 9. For vertical mounting, the LED's soft strip can be placed against the exterior of the gird, as shown in FIG. 10. The number of vertical LED 24 soft strips can vary from one to twenty +/− depending upon the desired results. The LEDs 24 could also be placed on the interior of the grid 16.

It is also possible to have two lamps within the center section of the luminare, one lamp mounted beneath the other. The top lamp is mounted in the center to illuminate the interior of the grid 16, the lower lamp (beneath the top lamp) with the use of the proper reflectors would be used to illuminate the space between the grid 16 and the outside plastic diffuser and/or stone, marble etc.

The sources can be inter-changed LEDs 24 used for the center source and metal halide, PL or T2 T5 fluorescent lamps can be used for the inner source.

A third source 26 can be mounted in the fixture 12 structure and used with or without a reflector for downlight, as shown in FIG. 5. The reflector can be aluminum, polished or satin, anodized and/or painted. The reflector can also be made of steel and/or glass and properly coated and treated to provide the desired and required effects for walkway, night lighting, and ground cover illuminations.

Each source can be individually switched and/or circuited, dimmed and/or sequenced and/or chased.

The finish of the fixture 12 structure can be polished or satin stainless or anodized or duronodic if made of aluminum, it can be painted irrespective of which metal is used for the construction. If the construction is marble, granite, stone, etc., the finishes can be appropriate to the material used.

The fixture 12 can be wall surface mounted for uptight and/or uplight/downlight. They can be mounted above ground for low level (6-18" height), medium level (18"-40" height), walkway (residential or commercial) (40"-96" height), campus lighting (96"-168" height) or for parking lot or area lighting where the mounting height might be 20'-30' or more. The fixture 12 can be free standing and the fixture 12 can be mounted to a ceiling and extend downward or to a wall and extend horizontally relative to the ground from the wall.

The grid 16 material whether polished stainless or satin stainless steel is readily available from manufacturers of grating or screen companies. One such manufacture is Hendrick Screen Co.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. An apparatus for lighting comprising:

a fixture having a central axis;

a first light source disposed in the fixture which produces light along the center axis;

a grid having slots which reflect the light radially outward from the center axis extending from the fixture along the center axis and illuminated by the first light source;

a translucent element extending from the fixture along the center axis and disposed about and in spaced relationship with the grid; and a second light source disposed between the element and the grid.

2. An apparatus as described in claim 1 including a cap disposed on the element and the grid.

3. An apparatus as described in claim 2 wherein the second light source includes LEDs.

4. An apparatus as described in claim 3 wherein the fixture includes circuitry to control the operation of the first and second light sources.

5. An apparatus as described in claim 4 including a third light source disposed in the fixture, and wherein the fixture has an opening in its side through which light from the third source emanates.

6. An apparatus as described in claim 5 wherein the LEDs parallel to the center axis.

7. An apparatus as described in claim 5 wherein the LEDs are disposed radially about the first light source.

8. An apparatus as described in claim 6 wherein the fixture, element and the grid are cylindrically shaped.

9. An apparatus as described in claim 5 wherein the cap has at least one mirror to reflect light from the first light source.

10. A method for lighting comprising the steps of:

producing light along a center axis of a fixture with a first light source disposed in the fixture;

reflecting the light radially outward from the center axis with a grid having slots extending from the fixture along the center axis and illuminated by the first light source;

transmitting the light through a translucent element extending from the fixture along the center axis and disposed about and in spaced relationship with the grid; and producing light with a second light source disposed between the element and the grid.

11. A method as described in claim 10 wherein the producing the light with the second light source includes the step of producing the light with LEDs.

12. A method as described in claim 11 including the step of controlling the first light source and the LEDs with circuitry to cause a desired lighting effect.

* * * * *